United States Patent [19]

Csatary

[11] 4,222,133

[45] Sep. 16, 1980

[54] SICKBED WITH HAMMOCK

[76] Inventor: Laszlo K. Csatary, 1913 Windsor Rd., Alexandria, Va. 22307

[21] Appl. No.: 947,588

[22] Filed: Oct. 2, 1978

[51] Int. Cl.[2] ..... A61G 7/02

[52] U.S. Cl. ..... 5/90; 4/450; 5/84; 5/122

[58] Field of Search ..... 5/81 R, 84–89, 5/90, 91, 92, 112, 122, 123; 4/113, 142, 146

[56] References Cited

U.S. PATENT DOCUMENTS

| | | | |
|---|---|---|---|
| 2,774,079 | 12/1956 | Flatley | 5/89 |
| 3,049,726 | 8/1962 | Getz | 5/86 |
| 3,381,315 | 5/1968 | Glassberg | 4/142 |
| 3,849,811 | 11/1974 | Cyll | 5/91 |
| 3,959,832 | 6/1976 | Parsons | 5/84 |

*Primary Examiner*—Casmir A. Nunberg

[57] ABSTRACT

The sickbed hammock which can be raised to a desired height above the mattress includes a cutout to the periphery and underneath of which a removable sanitary bowl is attached by fastening means or Velcro-strips. The bed is provided also with a timed swivel for causing a turning of the hammock within safe limits.

2 Claims, 5 Drawing Figures

FIG. 1
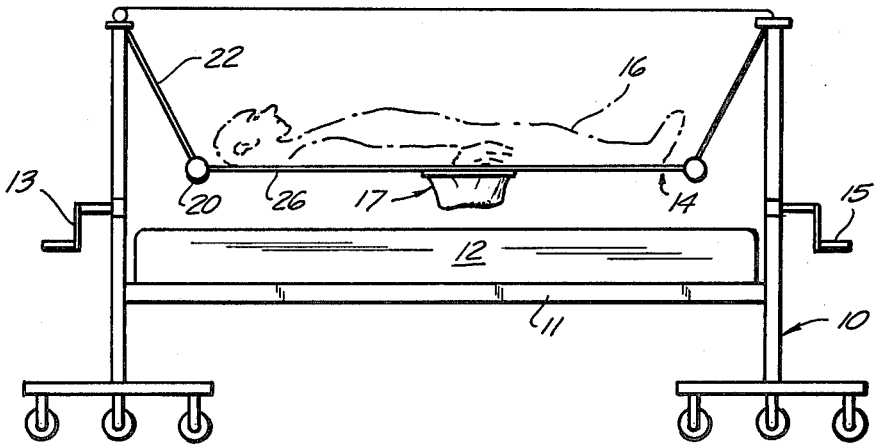
FIG. 2
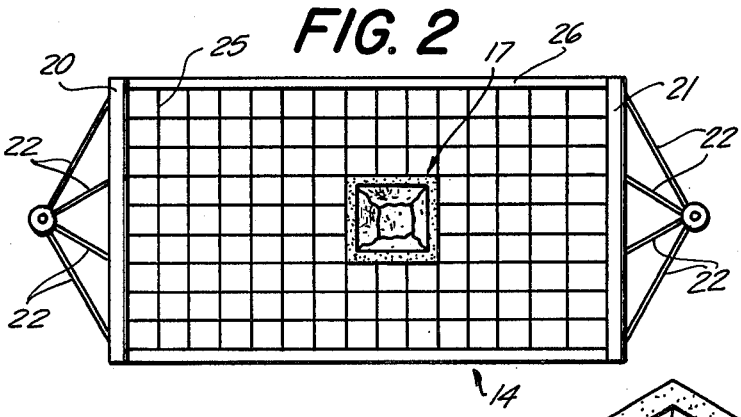
FIG. 3
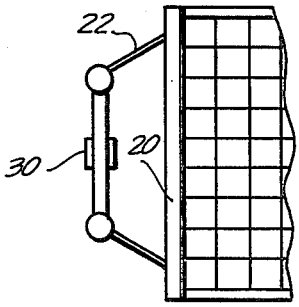
FIG. 5
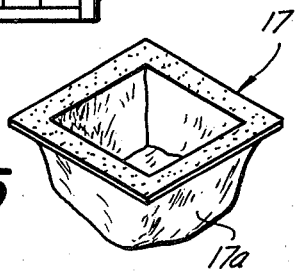
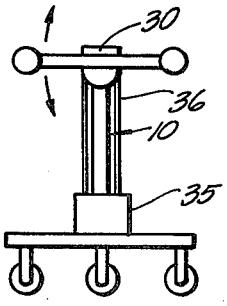
FIG. 4

SICKBED WITH HAMMOCK

FIELD OF THE INVENTION

The present invention relates generally to an improved hospital bed and, more particularly, it relates to an improved hospital bed having a separably supportable hammock in which the patient can be suspended above the bed for taking care of his or her sanitary requirements without the necessity of removing the patient from the bed or moving the body of the patient on the bed in order to enable the attending personnel to change the bed sheets, etc.

BACKGROUND OF THE INVENTION

The advance in the surgical techniques and hospital care requires also that the associated hospital equipment be also kept on par with the improvements in order to provide a better care and in order to make a better name for a hospital.

One of the problems associated with long term hospital care is decubitis which is amply treated by Sylvan E. Moolten MD in his article entitled "Bedsores" published in the May, 1977 issue of the Journal "Hospital Medicine."

The treatment of bedsores by way of improved care has been the subject of a number of patents and technical literature. The prior art activities can be considered to be exemplified by U.S. Pat. No. 3,959,832 issued to Vivian Parsons on June 1, 1976 wherein a invalid hammock is described which is directed to relieve the affect of bedsores or completely eliminate them by providing an improved hammock incorporating pressure relief points.

SUMMARY OF THE INVENTION

It is an object of the present invention to provide an improved hospital bed having an improved suspendable hammock therein which can be raised to a certain height enabling the changing of the bedsheet without interfering with the patient and also which includes a sanitary means to enable the patient to relieve himself without any assistance by the attending personnel and the exchange of such sanitary means without interfering with the position of the patient.

It is another object of the present invention to provide a hospital bed with the improved hammock as above wherein a timed swiveling means is associated with the hammock permitting the timed tilting of the hammock in one direction and, after a predetermined time, the tilt of the hammock in another direction in order to additionally relieve the pressure points on the back of the patient.

According to the present invention the suspendable hammock which can be raised to a predetermined height or to any height in-between includes a plurality of meshes which are formed by a resilient material so that they can become adjusted to the body of the patient thereby relieving the aches and pains of lying in bed, and wherein such hammock includes a cutout area containing a removable sanitary attachment hanging below the hammock into which the patient can relieve himself and which can be removed by simply stripping it off from the permanent frame area attached to the hammock as such frame area and the attachment on the sanitary means is made from mating Velcro-strips.

According to another aspect of the present invention, the suspension of the hammock is provided with a timing and tilting mechanism which enables, when actuated, the tilting of the hammock slowly in one direction and after a certain predetermined time the returning of the hammock to its center position and further tiltng it into the other direction.

The foregoing and other objects of the present invention will become apparent as the following description proceeds and features of novelty which characterize the invention will be pointed out in particularity in the claims affixed to and forming a part of this specification.

BRIEF DESCRIPTION OF THE DRAWING

The invention will become more readily apparent from the following description of a preferred embodiment thereof shown, by way of example, in the accompanying drawings, in which:

FIG. 1 is a schematic representation of a hospital bed with the hammock according to the present invention raised to a predetermined height and with the sanitary means attached under the hammock;

FIG. 2 is a schematic representation of the hammock according to the present invention as viewed from the mattress side showing the cutout for the attachment for the sanitary means according to the present invention;

FIG. 3 is a schematic representation of another embodiment of the hammock according to the present invention incorporating a two point suspension and the tilting mechanism according to the present invention;

FIG. 4 is a schematic representation of the suspension according to FIG. 3; and FIG. 5 is the removable sanitary means used in connection with the hammock of the present invention.

DESCRIPTION OF THE PREFERRED EMBODIMENTS

With reference to FIG. 1 it is seen that the hospital bed 10 is mounted on rollers and has a frame with two stands between which a boxspring 11 and a mattress 12 is supported in either a fixed fashion or in a fashion that they can be raised or manipulated in any fashion. Such basic hospital bed is well-known in the art and usually it requires a handle 13 which can perform the raising or lowering or the partial raising of the mattress 12. The bed 10 further includes a hammock 14 which is either can be lowered all the way to lie on the mattress 12 with the help of the handle 15 or to be raised also with the help of the handle 15 to practically any height above the mattress 12. The lowering or raising of the hammock 14 is not shown in detail here as it is the subject of well-known arrangements, such as also of the aforementioned prior art patent.

The hammock 14 can have a single point suspension as illustrated in FIG. 2 so that the patient 16 can be lowered up and down without changing his horizontal position on the hammock. A plurality of straps 22 are joined to the single suspension point which in turn is then joined to the suspension system by guide wires which are manipulated by the crankarm 15 in a known manner.

With closer examination of FIG. 2 it is noted that the hammock according to the present invention can have at the two ends the usual stiffening rods 20 and it is further provided by a much thicker stiffening side strips 26 which may be in the form of bars.

The hammock according to the present invention is made up from a plurality of rope strands or plastic 25 which are made into square or other type of meshes and which form a flexible support for the patient 16 lying on it. A cutout 17 is provided approximately in a portion of the hammock which is in the area of the anus of the patient 16 so that the cutout 17 could provide a relief for patients of both sexes. As can be seen in FIG. 2 the square or any pattern cutout which for illustrative purposes is shown as a square, has a permanently sewn-in frame made from one type of Velcro-strip while the cooperating removable and disposable sanitary means 17 has the mating type Velcro-strip which on its back has a plastic bag 17*a* secured to it and hanging down from it. As can be seen from the shown of FIGS. 2 and 5 the patient 16 can readily relieve himself straight into the sanitary means 17 without the necessity of moving or being moved and which is then ripped off and replaced by another one. Of course the hammock must be raised to at least a few inches in order to have the removable sanitary means 17 available for the relief of the patient. For practical purposes, a transparent bag is preferred.

With reference to FIGS. 3 and 4 it is seen that a two point suspension is provided for the hammock of the present invention into which a coupling gear 30 is incorporated and which performs a timed swiveling of the crossbar 20 to the right and after a certain time to the left in order to provide an additional relief for the patient or at least to enable just a slight turning of the patient over the hammock. Of course such swiveling motion is extremely slow and for the observer cannot even be seen during a short period of time and for the patient it is practically unnoticeable.

In order to bring about the slow swinging motion of the hammock an operating device 35 is operatively joined to the coupling gear 30 by a driving means 36, such as a chain or belt drive, is provided. Operating devices of this kind are well known on the market as bed rocking or cradle rocking devices and can be readily adapted into the structure of the present sick bed and it is not the intent here to claim such devices per se. Such adaptable devices are exemplified, out of the large number available, by U.S. Pat. No. 2,076,675 of Sharp issued Apr. 13, 1937 or U.S. Pat. No. 3,737,924 of Davis issued June 12, 1973.

As can be seen I have provided an improved hospital bed with a hammock which enables the attending personnel to perform additional duties by relieving the patient without the necessity of moving the patient and which hammock in addition provides relief against decubitis along with additional means of turning the patient.

I wish it to be understood that I do not desire to be limited to the exact details of construction shown and described, for obvious modifications will occur to a person skilled in the art.

Having thus described the invention, what I claim as new and desired to be secured by Letters Patent, is as follows:

1. A sickbed comprising a frame, a hammock mounted on said frame, means for mounting said hammock on said frame for raising and lowering said hammock onto and above the mattress of said bed, said hammock comprising a plurality of flexible strip means forming a mesh-like configuration, a cutout means in said hammock, and means for removably attaching a sanitary bowl to said cutout from underside of said hammock, wherein said hammock at each end thereof comprises a stiffening rod means, means for flexibly connecting said stiffening rod means to a suspension point on each side of said hammock for joining said hammock to said frame, wherein said sanitary cutout in said hammock comprises a Velcro-strip means circumferentially and a sanitary bowl of the disposable type is removably attached to said Velcro-strip means, and swiveling means comprised in said frame for causing when actuated a timed slow swiveling of said hammock in a predetermined direction, wherein said sanitary cutout in said hammock comprises fastening means and said sanitary bowl of the disposble type and made from a soft plastic material including mating fastening means is removably attached to said fastening means on said cutout.

2. The sickbed as claimed in claim 1, wherein said suspension point is a two point suspension means joining timed slow swiveling of said hammock in a predetermined.

* * * * *